US005431403A

United States Patent [19]

Pelz

[11] Patent Number: 5,431,403

[45] Date of Patent: Jul. 11, 1995

[54] GOLF PUTTING PRACTICE DEVICE WITH PERFECT PUTTING SURFACE

[76] Inventor: David T. Pelz, 3 Monarch Oaks La., Austin, Tex. 78738

[21] Appl. No.: 193,869

[22] Filed: Feb. 9, 1994

[51] Int. Cl.[6] ..... A63B 69/36

[52] U.S. Cl. ..... 273/178 B; 273/176 H; 273/34 B

[58] Field of Search ..... 273/34 R, 34 B, 191 R, 273/192, 35 A, 195 B, 178 B, 176 R, 177 R, 181 K, 182 R

[56] References Cited

U.S. PATENT DOCUMENTS

| | | | |
|---|---|---|---|
| 1,612,291 | 12/1926 | Jackson | 273/178 B |
| 2,894,755 | 7/1959 | Scelzo, Jr. | 273/192 |
| 3,332,688 | 7/1967 | Gevertz | 273/192 |
| 4,828,267 | 5/1989 | Goodrich | 273/182 R |
| 4,906,006 | 3/1990 | Sigunick | 273/34 R |
| 4,922,153 | 5/1990 | Schaefer | 273/35 A |
| 5,102,141 | 4/1992 | Jordan | 273/182 R |
| 5,209,484 | 5/1993 | Randall | 273/192 |

FOREIGN PATENT DOCUMENTS

| | | | |
|---|---|---|---|
| 301646 | 12/1928 | United Kingdom | 273/192 |

*Primary Examiner*—V. Millin
*Assistant Examiner*—Steven B. Wong
*Attorney, Agent, or Firm*—Aquilino & Welsh

[57] ABSTRACT

A golf putting device having a perfect surface to simulate a three foot putt on an actual outdoor putting green, enabling a golfer to develop a proper and consistent three foot putting stroke and develop proper muscle memory therefrom. The surface includes an adjustment and a level indicator to enable the surface to be located precisely level on any reasonably flat support surface and hole width restrictors to narrow the hole width while maintaining the hole depth constant. The surface is slightly raised and formed with a nap surface to more accurately simulate the conditions encountered on an actual putting green.

8 Claims, 2 Drawing Sheets

GOLF PUTTING PRACTICE DEVICE WITH PERFECT PUTTING SURFACE

BACKGROUND OF THE INVENTION

In order to develop a dependable putting stroke to aid a golfer in holing a maximum amount of putts from a putting green, it is essential that a repeatable golf stroke be developed. This is extremely difficult to do on a golf putting green because of imperfections which cause results to which golfers subconsciously adjust their strokes while practicing putts. Similarly, the surface and/or level of an indoor putting surface, such as a carpet, will rarely allow golf balls to roll exactly in the direction as dictated by the actual motion of the golfer's putter head. Furthermore, imperfections in the subsurface are almost always present and these also tend to cause results to which golfers also manipulate their strokes.

A prior art golf putting trainer to Thomas (U.S. Pat. No. 5,069,455) discloses a putting surface which is adjustable in height in selected locations using a specific adjustment mechanism. The surface is also covered with one of a selection of interchangeable surface materials of different friction and texture in combination with the undulating surface to simulate different playing conditions.

The patents to Gervitz (U.S. Pat. No. 3,332,688) and Jack (U.S. Pat. No. 3,685,833) both are directed to golf putting practice devices which are designed to enable a golfer to determine the path of the putter head during the execution of a stroke. Many other prior art putting devices are known, including my own U.S. Pat. No. 4,437,669, which relates to a golf practice putting track contoured to follow a putter head during a stroke and which has adjustably positioned rails to increase or decrease the space in which the putter head is swung without hitting either of the rails.

SUMMARY OF THE INVENTION

The present invention is a golf putting practice device with a perfect putting surface whereby putts roll true and precisely reflect the stroke made by the golfer, with no outside interference from the putting surface. The device includes a planar, upper surface which is slightly inclined upwardly and which is covered by a smooth carpet or similar roughened surface to simulate the texture of a natural and smooth putting green. Alignment lines are provided along the edges to aid the golfer in aligning the putter blade square to the hole. The device includes a mirror, allowing the golfer to check his eye position on every putt to ensure that the eyes are always in the vertical plane above the putt line. A pair of legs are used to raise the far end of the device slightly above the ground to duplicate the three foot putt speed of a normal golf course green. One leg is permanently fixed, whereas a second leg is vertically adjustable using a level control knob, in order that the top surface be always perfectly horizontal and level. A bubble-type level indicator is provided adjacent the hole to ensure that the device is precisely level.

The hole reflects a size slightly smaller than normal sized holes as used on a golf course to duplicate the exact difficulty in holing three foot putts which golfers actually encounter on real golf greens, which contain footprints and spike mark imperfections. Also, the device is provided with restrictors to narrow the width of the hole while leaving the length of the hole as above, to provide a more precise target for the golfer as his or her skill level warrants.

Among the objects of the present invention are the provision of a golf putting practice device having a perfect putting surface whereby the direction and distance the putt rolls will always precisely reflect the golfer's putting stroke, with no outside interference from the putting surface.

Another object is the provision of a golf practice putting device which will accurately simulate the speed and "difficulty to make" factor of a three foot putt of a conventional golf putting green.

Still another object of the present invention is the provision of a putting device in which the putting surface may be manually adjusted to a precise level, and wherein such level is reflected by an indicator.

Still another object of the present invention is the provision of a putting device in which the width of the hole target may be adjusted to be narrower to maintain or increase the difficulty and challenge of making putts while simultaneously maintaining the depth of the hole at an original size to optimize the speed of putts so they are consistent with putts made on actual golf courses.

Another object is to provide a practice putting device which will aid a golfer in improving his talent and skill level to make increasingly better putting strokes Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
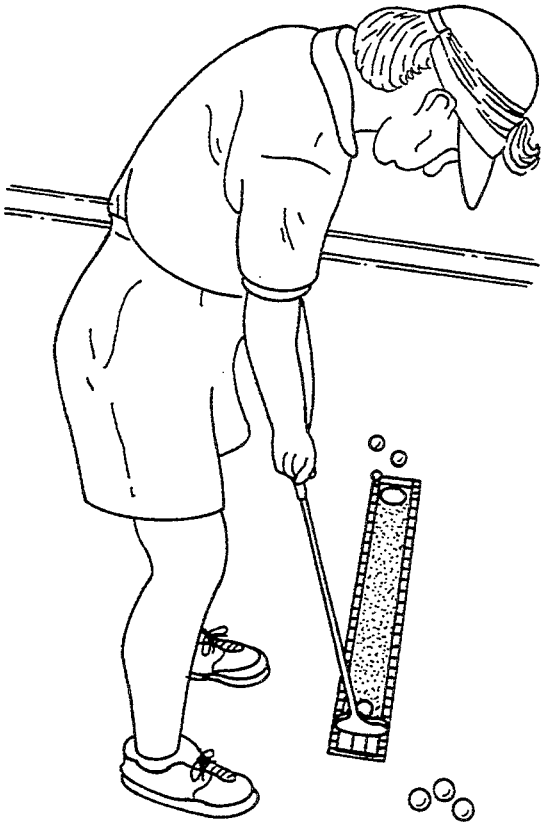
FIG. 1 is a pictorial view of a golfer using the present invention.
Figure 2:
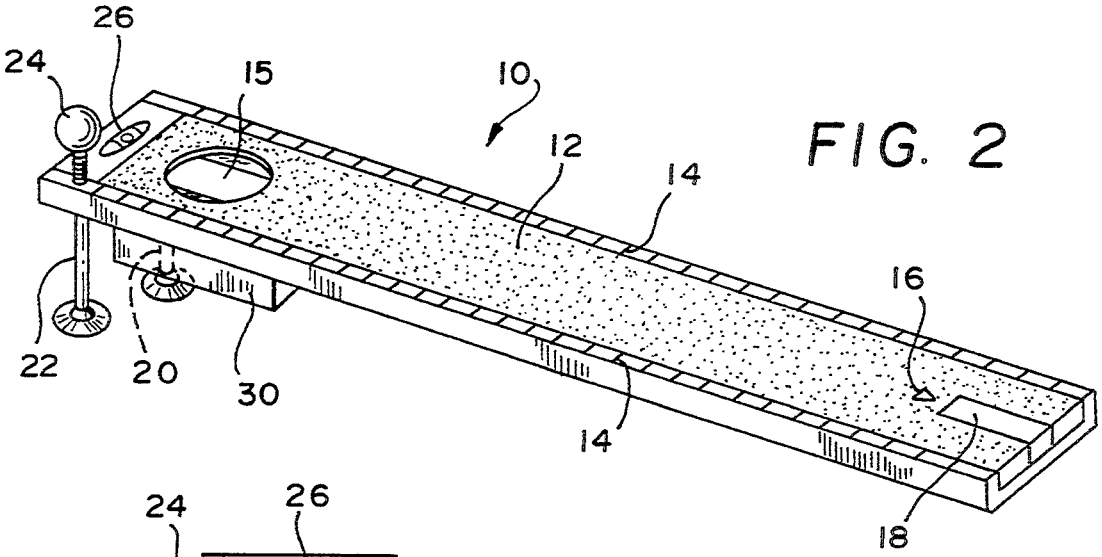
FIG. 2 is a perspective view of the practice device of the present invention.
Figure 3:
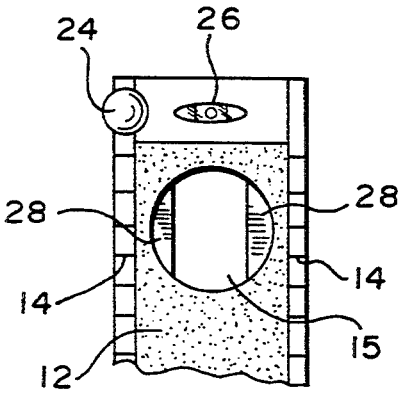
FIG. 3 is a top plan view of the practice device of FIG. 2.
Figure 4:
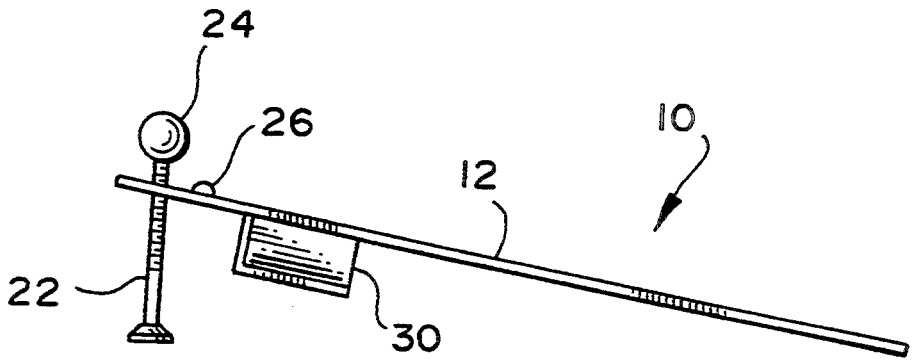
FIG. 4 is a side elevational view of the device of FIG. 2.
Figure 5:
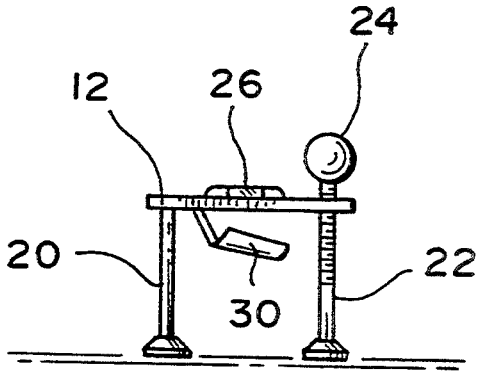
FIG. 5 is an end elevational view of the device of FIG. 2.

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The present invention relates to a golf putting practice device with a perfect putting surface which will always tell the truth about a golfer's three foot putting stroke, or in other words, the direction and distance the putt rolls will always precisely reflect the physics of the motion of the practice stroke and the putter, with no interference from the putting surface itself. The level surface of the device ensures a footprint-free putting surface, so putts will always roll true in accordance with the stroke made by the golfer. The slight incline of the "truth board" duplicates a three foot putt speed of a normal golf course green, and this will help the golfer groove his touch for success while playing an actual round of golf.

Referring to the drawings, the golf putting practice device 10 of the present invention is formed with a planar upper surface 12 having a smooth carpet or similar roughened surface to simulate the texture of a natural smooth putting green, and a simulated hole 15 at one end thereof. Putter face alignment lines 14 are provided along the outer edges of the upper surface 12 to aid the golfer in aligning the putter blade square to the hole. Not only do the alignment lines establish the putter face perfectly square at address, they also allow a golfer to check for club face squareness at the finish of the stroke. The putting device 10 is provided with a ball position spot 16 which may be a slight depression in the carpet surface, which is positioned exactly on the center line of the planar upper surface 12 of the device 10, to ensure that the ball is aligned in the same place every time a practice stroke is made. A mirror 18 checks the eye position of the golfer on every putt to ensure that the eyes are always vertical above the putt line.

A pair of legs 20 and 22 are used to raise one end of the planar surface of the device slightly above the ground. The slight incline duplicates the three foot putt speed of a normal golf course green. Leg 22 is permanently fixed and leg 20 is vertically adjustable using a level control knob 24 so that the top surface may be easily adjusted to be perfectly level.

The device 10 is provided with a bubble-type level indicator 26, preferably mounted close to and behind the simulated hole 15. The bubble level indicator 26 is used to determine that the planar surface 12 is precisely level as a result of the vertically adjustable leg 20 being adjusted.

The hole 15 can be provided with devices 28 which may be inserted in the hole 15 to restrict the width of the hole 15, while maintaining the original depth of the hole 15, in order to provide a more difficult and precise target. The inserted devices 28 preferably conform to the radius of the hole and include an upper surface which smoothly interface with the planar upper surface 12.

A ball deflector 30 is also provided to collect the golf balls that fall into the hole 15 to direct the balls away from the underside of the practice device.

While a various preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A golf putting practice device comprising:

an elongated planar upper surface having a smooth texture to simulate a natural smooth putting green;

said elongated upper surface having a first end and a second end opposite said first end;

a hole having an opening in said upper surface adjacent said first end;

a teeing area adjacent said second end;

a pair of legs, one of said legs being vertically adjustable to adjust the position of said planar upper surface;

a level indicator to indicate the position of said planar surface; and, removable hole restrictors structured to be placed in said hole to narrow the size of the hole opening to provide a more narrow and precise target, while maintaining the linear dimension of the hole in the first to second end direction.

2. The golf putting practice device of claim 1 wherein said level indicator is a bubble-type level.

3. The golf putting practice device of claim 2 further including a mirror at said teeing area of the device to enable a player to check his eye position to ensure that the eyes are always vertical above the putt line.

4. The golf putting practice device of claim 3 further including putter face alignment lines positioned along the length of the device on opposite sides of said planar upper surface.

5. The golf putting practice device of claim 1 wherein said restrictors are inserts conforming to the radius of the hole and said planar upper surface.

6. The golf putting practice device of claim 1 further including a deflector plate positioned beneath the hole to direct golf balls falling into the hole away from the undersurface of the device.

7. The golf putting practice device of claim 1 wherein said planar upper surface is formed with smooth carpet.

8. The golf putting practice device of claim 1 wherein said teeing area includes a ball position spot precisely located along a center axis of said planar upper surface.

* * * * *